United States Patent [19]

Lecznar et al.

[11] 4,416,600

[45] Nov. 22, 1983

[54] APPARATUS FOR PRODUCING HIGH PURITY METAL POWDERS

[75] Inventors: Chester J. Lecznar, Warren, Mich.; Griff E. Williams, Salt Lake City, Utah

[73] Assignees: Griff Williams Co., Salt Lake City, Utah; Ryan Metal Powder Technologies, Inc., Warren, Mich.

[21] Appl. No.: 347,409

[22] Filed: Feb. 10, 1982

[51] Int. Cl.[3] ..... B01J 2/02

[52] U.S. Cl. ..... 425/7; 425/10

[58] Field of Search ..... 425/7, 10

[56] References Cited

U.S. PATENT DOCUMENTS

| | | | |
|---|---|---|---|
| 1,659,291 | 2/1928 | Hall . | |
| 3,253,783 | 5/1966 | Probst et al. . | |
| 3,501,802 | 3/1970 | Ullman et al. | 425/7 |
| 3,639,548 | 2/1972 | Ullman et al. . | |
| 3,695,795 | 10/1972 | Jossick | 425/7 |
| 3,771,929 | 11/1973 | Hellman et al. | 425/7 |
| 3,813,196 | 5/1974 | Backstrom et al. | 425/7 |
| 3,819,310 | 6/1974 | Mavrovic | 425/7 |
| 3,826,598 | 7/1974 | Kaufman . | |
| 3,901,492 | 8/1975 | Lafferty . | |
| 4,135,903 | 1/1979 | Ohsato et al. . | |

*Primary Examiner*—James R. Hall

*Attorney, Agent, or Firm*—Krass, Young & Schivley

[57] ABSTRACT

Apparatus is disclosed for producing high purity metal powders of precisely controlled particle size. The apparatus employs a system for atomizing a stream of molten metal by a swirling fluid. After initial system set up, different particle sizes may be produced merely by interchanging atomization fluid inserts. Each replaceable atomization fluid insert includes an inlet for receiving a single gas supply at a fixed pressure. A spiral channel in the insert of decreasing cross-sectional dimension extends from the inlet to an outlet surrounding the streams of molten metal. The channel configuration of each of the replaceable inserts is designed so that a preselected atomization fluid velocity and/or spiral rate is provided for atomizing the molten metal to the desired particle size. Gas jets in a depending cooling tank are used to rapidly cool the particles while keeping them from impinging against the wall of the tank. Upwardly directed gas jets in the tank are employed to keep the particles suspended in the tank until they are cooled to a desired temperature.

10 Claims, 7 Drawing Figures

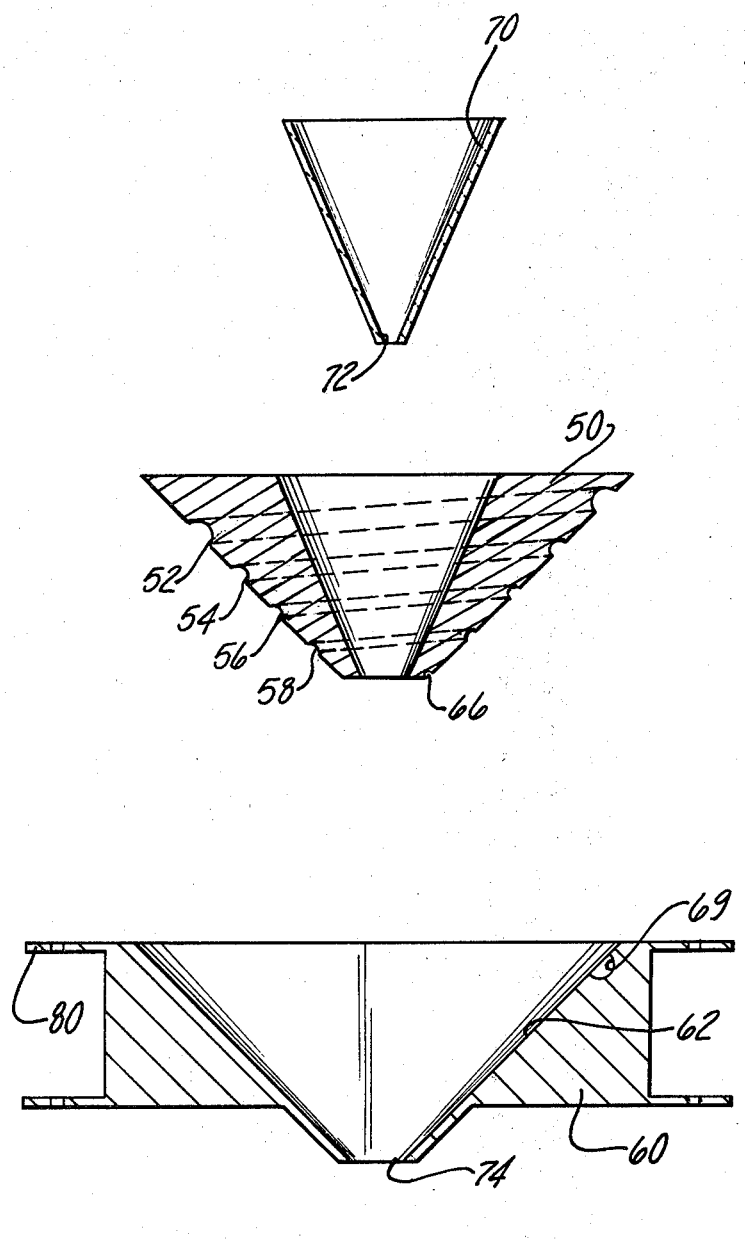
Fig-5
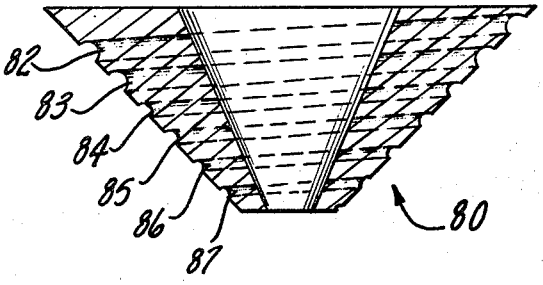
Fig-6
Fig-7
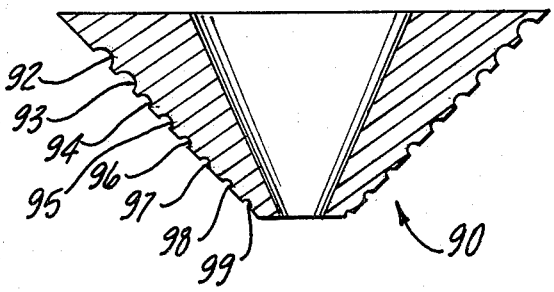

APPARATUS FOR PRODUCING HIGH PURITY METAL POWDERS

DESCRIPTION

Technical Field

This invention relates to techniques for producing metal powders and, in particular, to apparatus for producing metal powders by atomization with a spiralling fluid stream.

Background Art

It is recognized that quality parts may be produced by powder metallurgy methods. Such parts are traditionally made by filling the part die with a suitably blended metal powder, cold pressing the part in the die and then sintering the pressed part. Various finishing operations may be used.

Metal powders have also enjoyed increasing use in the aircraft and aerospace industries where the metal powders are used in brazings and coatings such as plasma spray, flame spray, and pack coatings.

The original metal powders may be produced by gas atomization or by water atomization, although the former process enjoys certain advantages. Atomization occurs when a stream of liquid metal falls vertically through the cross fire of either a liquid or gaseous stream. The stream impinging upon the liquid metal is used to break up the liquid metal into discrete particles. In general, gaseous atomization produces rounded or spherical particles and water atomization produces irregular particles. An excellent review of the patent and published literature on powder metallurgy may be found in Beddow, *The Production of Metal Powders by Atomization*, Haden and Son, Ltd., 1978.

U.S. Pat. No. 3,639,548 to Ullman and Lecznar discloses a particularly advantageous method of producing metal powders. In that patent two tangential gas inlets are introduced into a generally annular shaped nozzle to provide a spiralling or "tornado" effect to the atomization fluid adjacent the exit of the molten metal nozzle. U.S. Pat. Nos. 1,659,291 to Hall, 3,253,783 to Probst et al; 4,135,903 to Oasato et al and 3,826,598 to Kaufman are representative of other techniques for providing a spiralling atomization fluid stream.

In the past it has been difficult for the manufacturer to produce a high yield of metal powder of a predetermined particle size using the aforementioned atomization processes. The art does recognize that the fineness of the powder is affected by the shear velocity and angle of contact of the atomization fluid with the molten metal. In an effort to increase yields the input pressure to the atomization head has been adjusted in an attempt to optimize the percentage of desired particle sizes. However, this gross adjustment has been found to only marginally affect the control of the produced particle size. The spectrum of particle sizes produced by conventional methods is so wide that in order to extract a close particle size range a screening process becomes necessary to remove the unwanted size particles. Unfortunately, this can be very costly as it wastes a great quantity of material and adds the additional burden of screening time.

DISCLOSURE OF THE INVENTION

One aspect of this invention broadly contemplates the use of an atomization unit having interchangeable inserts which are individually designed to provide the precise atomization fluid shear velocity and/or spiral configuration necessary to atomize the molten metal into a given particle size. The use of the interchangeable atomization inserts enables the manufacturer of metal powders to produce powders of a selected particle size merely by using a specifically designed insert for that particle size. The other system parameters remain substantially the same. As a consequence, the same gas intake pressure may be utilized in all cases since the atomization inserts account for the individual tailoring of the ultimate fluid shear velocity and contact configuration used to atomize the molten metal.

In the preferred embodiment, the atomization unit includes a receptacle for receiving the atomization inserts. Each insert includes open ended spiral channels which are closed when the insert is inserted into the receptacle. The channel decreases in cross-sectional dimension from its inlet to its outlet. A single inlet fluid supply may be used for all of the inserts. However, the number of turns and cross-sectional dimensions of the spiral channel in each of the inserts differs depending upon the size of the metal powders desired to be produced. The atomization unit also includes a ceramic funnel which serves as a nozzle for the molten metal and also acts to protect the atomization insert. The aforementioned components along with a tundish for receiving the melt may be clamped together to provide the completed atomization unit.

The system of the present invention further includes a cooling or separation tank depending from the atomization unit. Several tangential gas jets within the tank are advantageously used to rapidly cool the particles and keep them from impinging against the wall of the tank. In such manner the precise spherical shape of the particles is maintained. A second set of jets pointing upwardly in the tank provide a field gas to keep the particles suspended within the tank until they reach room temperature at which time the particles drop onto either a vibrating screen separator, or a conveyor.

In the method associated with this invention a first production run is made with a given gas intake pressure to produce metal particles of a given size. A second production run is made at substantially the same gas intake pressure but a different atomization insert is utilized with a different spiral channel configuration to produce metal particles of a different size. In such manner, course, medium and very fine particles can be produced without increasing or decreasing the gas intake. Thus, the atomization system of the present invention uses less gas as well as giving positive particle size control. Since the yield of a particular particle size is optimized by this approach less screening time is needed or may be eliminated altogether.

BRIEF DESCRIPTION OF THE DRAWINGS

The full range of advantages of the present invention will become apparent to one skilled in the art after reading the following specification and by reference to the drawings in which:

FIG. 5 is an exploded view of components making up the atomization unit; and

FIGS. 6 and 7 are cross-sectional views of inserts having different channel configurations which may be used in the atomization unit of the preferred embodiment.

DESCRIPTION OF THE PREFERRED EMBODIMENT

Figure 1:
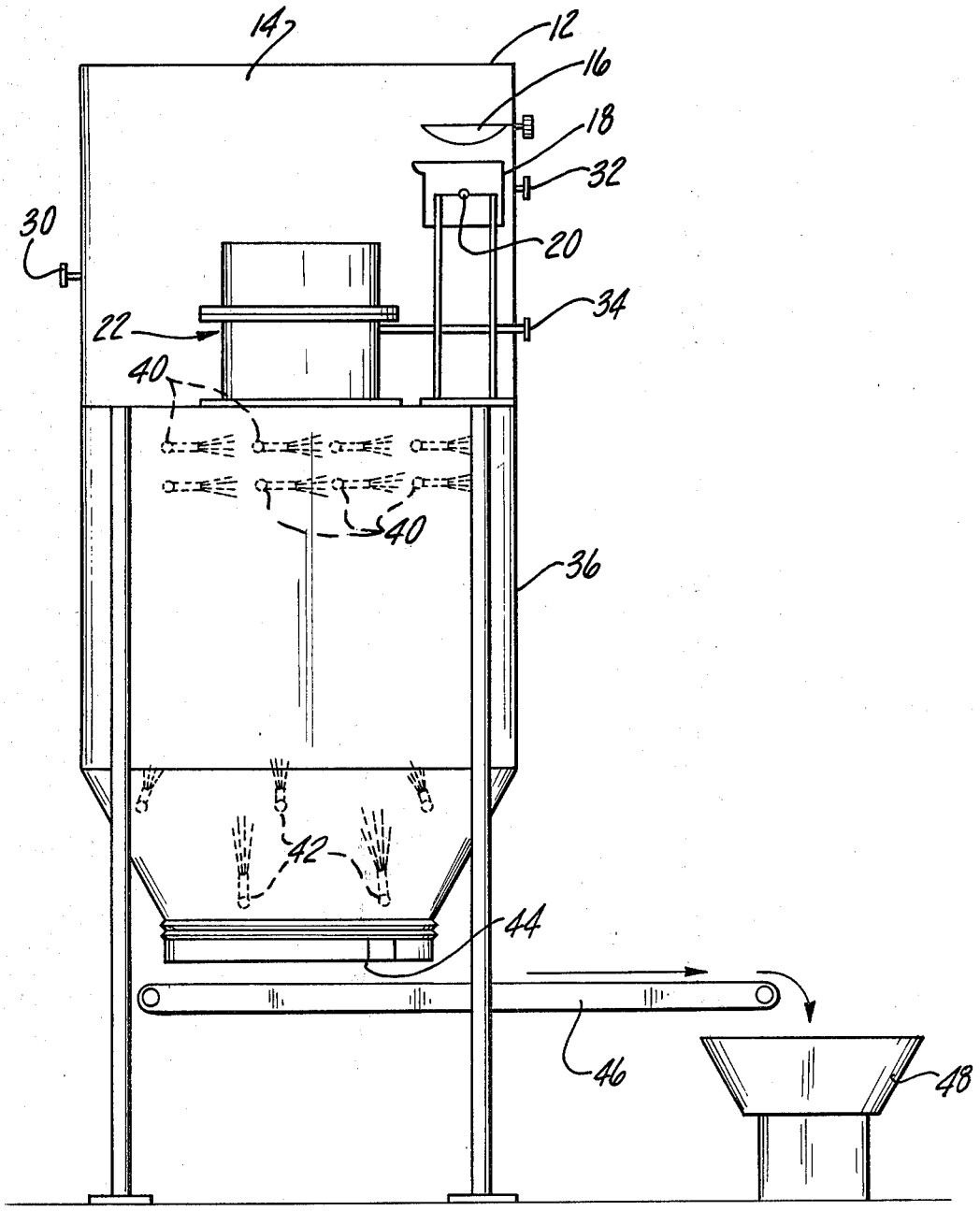
FIG. 1 is a side plan view of the preferred embodiment of the metal powder atomization system of this invention.
Figure 2:
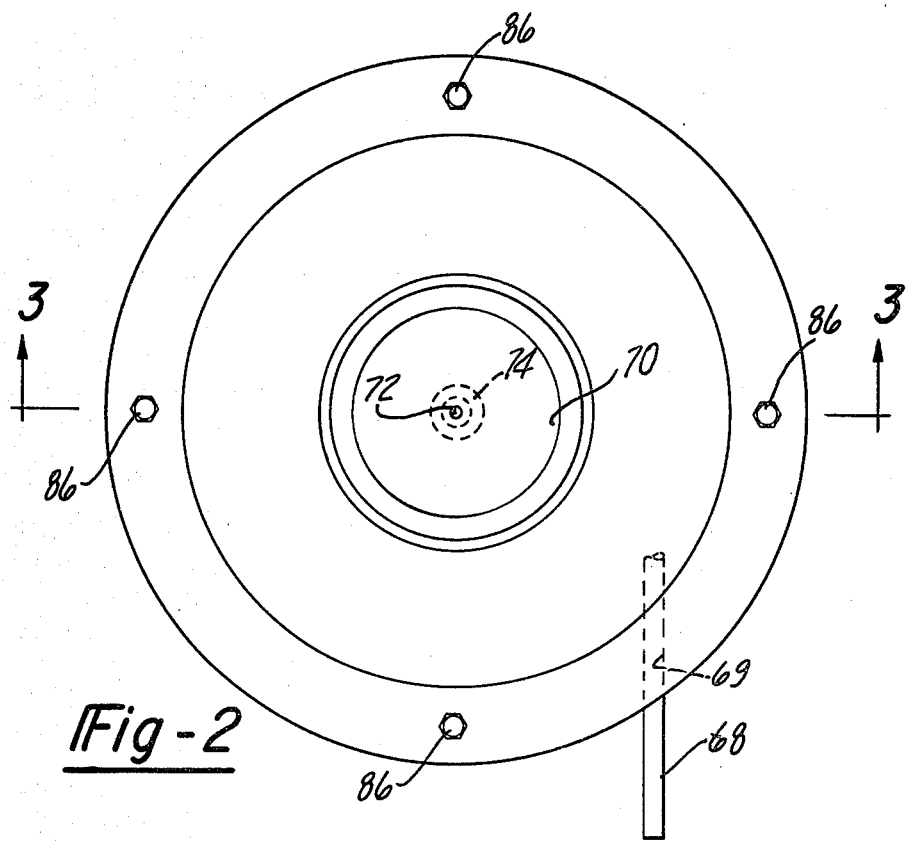
FIG. 2 is a top plan view of an atomization unit which may be used in the system of FIG. 1.

Referring now to FIG. 1, the apparatus of the preferred embodiment of the present invention takes the form of a vertically oriented tower. The upper portion of the tower is provided with an air tight steel enclosure 12 defining an inner chamber 14. A raw material adder represented by ladle 16 serves to hold the solid metal that is to be atomized into powder by the system. A furnace disposed beneath ladle 16 is adapted to receive the solid metal particles spilled from ladle 16 and melt them to a predetermined temperature. The furnace advantageously employs a crucible 18 which may be heated by suitable means such as by induction heating coils surrounding crucible 18. Crucible 18 is mounted on a trunion 20 operable to move the crucible into a position and orientation whereby the molten metal is poured into atomization unit 22.

The atmosphere within the entire inner chamber 14 may be controlled by gas line connection 30. Thus, chamber 14 can either be evacuated with a vacuum pump or filled with an inert gas such as argon, or nitrogen to protect the molten metal from picking up unwanted gasses such as oxygen and hydrogen, thus giving a cleaner product. Air tight connectors 32 may be employed to introduce power to the furnace.

An atomization fluid connector 34 supplies the atomization fluid, preferably an inert gas, to unit 22. Pressure regulator devices (not shown) may be used to control the gas intake pressure although the ultimate control of the atomization fluid pressure is controlled by the atomization insert as will appear later on in this description. An elongated hollow tank 36 depends from the atomization unit 22 for receiving the particles issuing therefrom. According to a feature of this invention the tips of a plurality of tangential jets 40 spaced about the inner periphery of tank 36 serve to provide a stream of gas to rapidly cool the hot atomized particles and keep them from impinging against the wall of the tank. In such manner the perfect spherical shape of the particles are maintained and any tendency for them to agglomerize by impingement against the tank wall is kept to a minimum. At the lower portion of the tank 36 the tips of gas jets 42 provide a generally upwardly directed stream of gas to provide a field to keep the particles suspended within the tank until the individual particles reach a temperature at which they freeze or cool into discrete solid powder particles. After the particles are sufficiently cooled they exit from the opening 44 at the bottom of the tank onto a conveyor 46 which carries the particles into a hopper 48. Alternatively, conveyor 46 can be replaced by a vibrating screen separator to separate the powders into various particle sizes. However, this screeening process is not always necessary because the system of the invention has the capability of controlling the particle size to such a high degree of accuracy.

Turn then to the details of the atomization unit 22 shown most clearly in FIGS. 2–5. Central to the design of the atomization unit 22 is the atomization insert 50. Insert 50 is a hollow V-shaped cone made of a rigid material such as metal, preferably, stainless steel. A plurality of spiral channels 52–58 of progressively decreasing cross-sectional dimension are machined in the outer periphery of insert 50. Conveniently, channels 52–58 may be formed by a tracer lathe such that their cross-sectional shape is semi-circular. Each channel makes one complete revolution generally normal to the major axis of the head and then is joined with its adjacent channel.

Figure 3:
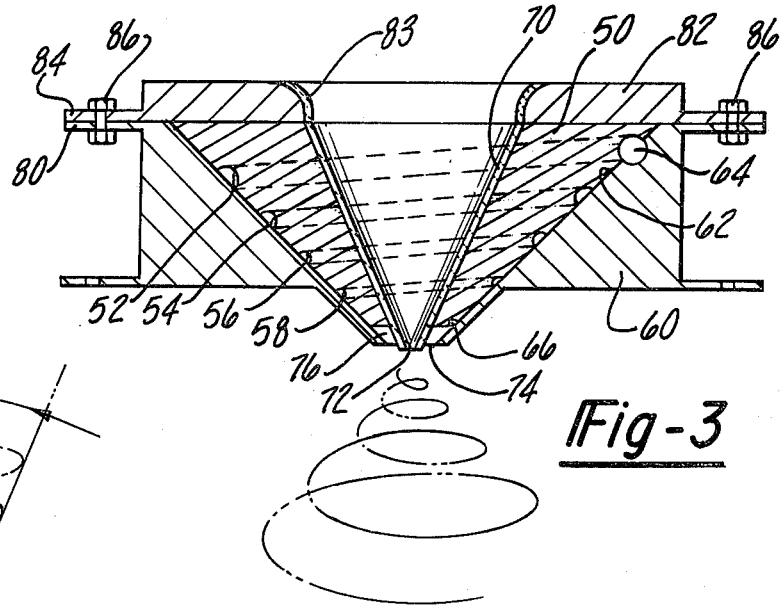
FIG. 3 is a cross-sectional view of the atomization unit along the lines 3—3 of FIG. 2.
Figure 4:
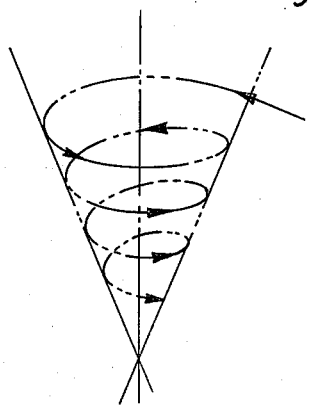
FIG. 4 schematically illustrates the travel of the fluid stream in the atomization unit.

Insert 50 is designed to be nested into a base or receptacle 60 as can be seen most clearly in FIG. 3. The smooth cone-shaped inner surface 62 of receptacle 60 serves to close off the open ended channels 52–58 to form a sealed, continuous passgeway. The cooperation of insert 50 and receptacle 60 thus defines a counterclockwise spiral duct of decreasing cross-sectional dimension from inlet 64 to outlet 66.

The inlet 64 to the spiral duct is connected to a single atomization fluid supply line 68 passing through a generally tangential bore 69 in receptacle 60. Supply line 68 may typically be provided by way of conventional copper tubing which in turn is connected to the fluid connector 34 (FIG. 1) and then to a fluid supply tank.

A high temperature resistant ceramic funnel serves as molten metal nozzle 70. Nozzle 70 nests on the smooth inner surface of insert 50 and its outlet 72 protrudes slightly through an opening 74 in the cone-shaped bottom of receptacle 60. As can be seen most clearly in FIG. 3 the truncated bottom of insert 50, the inner surface 62 of receptacle 60, and the outer walls of nozzle end 72 define an exit chamber 76. The outlet 66 in the spiral duct in insert 50 empties into chamber 76 in such manner that the atomization fluid is caused to spiral or generate a "tornado effect". The spiralling atomization fluid exits through opening 74 and contacts the molten metal leaving outlet 72 to atomize the metal into discrete particles.

Receptacle 60 includes a lower flange 78 which is bolted to the top of tank 36 and an upper flange 80 for receiving a tundish 82. Tundish 82 is generally an annular metallic collar in which the inner surface thereof is lined with high temperature ceramic 83. Tundish 82 includes an outer bolt flange 84 for mating with receptacle flange 80 to clamp all of the aforementioned components of the atomization unit 22 together. Thus, it can be seen that each of the individual components, especially atomization insert 50, may be easily replaced by unbolting the unit and inserting a new part.

Those skilled in the art can now appreciate that the present invention offers significant advantages over gas atomization systems known in the art. The same apparatus may be used to produce metal particles of different particle size without any substantial modification. A plurality of different atomization inserts 50 may be kept on hand, each insert being specifically designed to produce a particular particle size. The inserts will be substantially the same except that the dimension and/or number of the channels will be specifically designed to compress the fluid to provide the precise atomization fluid shear velocity and tightness of the spiralling fluid flow necessary to optimize the yield for a given particle size. For example, by decreasing the ratio of the outlet 66 size to the inlet 64 size the pressure and, hence, shear velocity of the atomization fluid will be increased. Larger particle sizes can be produced by increasing this ratio. Likewise, the number of turns per unit length of the channels will effect the number of rotations of the atomization fluid per unit length contacting the molten metal. For example, an increase in number of channel turns will provide a tighter spiral of the atomization fluid. The contact configuration of the atomization fluid will effect particle size and shape. The number of turns of the channels should preferably be increased for decreasing desired particle size.

The preferred embodiment of this invention employs three different atomization head inserts. In FIGS. 2–5, the insert 50 has four spiral channels 52–58 with radiuses of ¼", 3/16", ⅛", and 1/16". This insert is used to produce coarse particles of about −20 mesh to +140 mesh. The insert 80 shown in FIG. 6 has six spiral channels 82–87 with radiuses of 3/16", 3/16", ⅛", ⅛", 1/16" and 1/16". This insert is used to produce medium size particles of about +140 mesh to +325 mesh. The insert 90 shown in FIG. 7 has eight spiral channels 92–99 of radiuses 3/16", 3/16", ⅛", ⅛", 1/16", 1/16 ", 1/32" and 1/32". This insert is used to produce very fine particles of about −325 mesh to down to about 1 micron.

The production of the various particle sizes by way of the spiralling atomization fluid may be accomplished through the use of only one fluid supply line although additional supply lines may be used if necessary to increase the gas volume when extreme submicron particles are required. Normally, the gas intake or volume of atomization fluid will be substantially the same even though the atomization shear velocities for the various inserts will differ quite dramatically. Thus, the atomization unit of the present invention is more efficient than conventional approaches since substantially the same amount of input atomization fluid is used in all cases, thus requiring the use of less gas in some instances while at the same time giving positive particle size control.

By way of a non-limiting example, the present invention will now be described in connection with producing powders from a nickel based alloy such as AMS 4777 having a chemical composition of 0.6% carbon, 4.5% silicon, 7.0% chrome, 3.0% boron, 3.0% Iron, and the balance nickel, by weight. The atomization insert of FIG. 6 was mounted in unit 22 as disclosed above. The metal melt stock was placed in crucible 18 of the furnace (FIG. 1) and the enclosure 12 sealed and filled with an inert gas such as argon. The stock was then melted in the furnace to a temperature of about 2450° F. and the molten metal poured into the tundish 82 of the atomization unit 22. Argon gas was used as the atomization fluid. The input gas pressure to connector 34 was about 200 psi.

As the molten metal exited nozzle 70 it was contacted by the spiralling gas stream and formed into spherical metal particles. As the particles fell within tower 36 they were cooled into solid particles before they impinged upon conveyor 46. The conveyor is positioned relatively close to the exit 44 such that the particles are collected in the inert gaseous environment to even further prevent unwanted oxidation. This process provided metal powders 90% of which were within −140 to +325 mesh size.

Those skilled in the art will appreciate that a wide variety of metal powders may be produced according to the teachings of this invention. Various atomization fluids can be utilized such as argon, nitrogen, liquid nitrogen, liquid helium and water. The system will permit vacuum and inert gas melting, inert gas atomization, and cooling of the particles into predefined particle sizes. All of this can be accomplished in a dry inert atmosphere producing clean, low gas content spherical metal powders free from surface oxides. Also, by cooling the atomization gas prior to atomization important metallurgical changes in the physical properties of the powder can be obtained. Denser particles and the elimination of half shell or hollow particles that usually form when the molten stream of metal is not broken up properly is effectively eliminated by this system. The field jets in the tank serve to eliminate satellites or tiny particles attaching themselves to larger particles by keeping the particles suspended within the tank until they reach a suitable cooling temperature. Also, the field jets serve to decrease the length of the tank that might otherwise be required.

The atomization unit itself is a compact and highly rugged structure. The spiralling gas channels are protected from coming into contact with any contaminating substance while the ceramic metal nozzle protects the metal insert from damage.

Still other advantages and modifications to this invention will become apparent to one skilled in the art upon a study of the specification, drawings and following claims.

We claim:

1. In an apparatus for producing metal powders, said apparatus including a source of atomization fluid, an atomization unit with a nozzle therein through which molten metal is poured and contacted with the fluid at an exit of the nozzle to atomize the metal into particles, and a tank particles as they fall from the unit to an opening in bottom portions of the tank where the particles may be collected;

the improvement comprising:

an interchangeable insert having a spiral channel of decreasing cross-sectional dimension formed therein, a receptacle for the insert, said channel cooperating with the receptacle to define a spiral duct of decreasing cross-sectional dimension from an inlet coupled to the source of atomization fluid to an outlet adjacent the exit of the nozzle, said duct being adapted to generate from said fluid source a rotating fluid of a given velocity at the outlet of the duct for atomizing the molten metal into preselected particle sizes, whereby inserts with different channel configurations may be used to produce powders of different particle sizes.

2. The improvement of claim 1 wherein:

said insert is generally cone-shaped and the spiral channel is formed on an outer surface thereof, with the receptacle having a smooth inner surface generally conforming to the outer surface of the insert and adapted to enclose said channel, and said nozzle nesting on an inner surface of the insert whereby said duct surrounds said nozzle.

3. The improvement of claim 2 which further includes:

a generally annular tundish disposed above said nozzle; and means for removably clamping said tundish, said nozzle, said insert and said receptacle together.

4. The improvement of claim 3 wherein said receptacle and tundish include mating flange portions which are bolted together.

5. The improvement of claim 3 wherein said tundish is made of metal and includes a ceramic lining on its inner surface.

6. The improvement of claim 1 wherein said tank includes a plurality of gas jet means disposed about its inner surface for preventing the particles from impinging sides of the tank; and a second set of gas jet means for providing a generally upward flow of gas to suspend the particles in the tank for a time sufficient to cool said particles to a generally solid form.

7. The improvement of claim 6 which further includes:

an upper sealed enclosure defining a chamber surrounding the atomization unit.

8. The improvement of claim 7 wherein said sealed enclosure and tank contain an inert gaseous atmosphere.

9. The improvement of claim 1 which further includes a vibrating screen disposed closely to the tank opening for receiving said particles and separating them into various sizes.

10. The improvement of claim 1 which further includes a conveyor disposed closely to the opening in the tank for receiving said particles and conveying them to a collection device.

* * * * *